United States Patent [19]

Matsuo

[11] Patent Number: 4,590,835

[45] Date of Patent: May 27, 1986

[54] CUTTER FOR FOOD MATERIALS

[75] Inventor: Takashi Matsuo, Hiroshima, Japan

[73] Assignee: Calbee Foods Co., Ltd., Tokyo, Japan

[21] Appl. No.: 714,390

[22] Filed: Mar. 21, 1985

[30] Foreign Application Priority Data

Mar. 23, 1984 [JP] Japan ..... 59-41522[U]

[51] Int. Cl.[4] ..... B26D 3/00

[52] U.S. Cl. ..... 83/698; 83/403; 83/856; 83/858

[58] Field of Search ..... 83/403, 404, 408, 698, 83/700, 856, 857, 858

[56] References Cited

U.S. PATENT DOCUMENTS 2,961,024 11/1960 Urschel et al. ..... 83/403

*Primary Examiner*—James M. Meister

*Attorney, Agent, or Firm*—Oblon, Fisher, Spivak, McClelland & Maier

[57] ABSTRACT

A cutter for food materials, has a holder including a corrugated distal end and an intermediate stepped portion forming a rearwardly extending groove. A corrugated cutter is disposed on the holder and includes a corrugated cutting edge extending forwardly of the distal end of the holder and a rearward end engaged in the groove. A vertical cutter located on the corrugated cutter and includes a plurality of vertically extending blades provided therein and spaced away from one another by a constant distance and a rearward end engaged in the groove. A clamp member is fixedly attached to the holder and pressed into engagement with the corrugated and vertical cutter, the distal end edge of the clamp member having a corrugation corresponding to that of the corrugated cutter and having slots each of which receives one of the vertically extending blades of the vertical cutter and has a length larger than the width of the blade.

2 Claims, 3 Drawing Figures

CUTTER FOR FOOD MATERIALS

BACKGROUND OF THE INVENTION

1. Field of the Invention

The present invention relates to a cutter for cutting food materials such as potato and the like into a particular configuration which is suitable for frying and roasting.

2. Description of the Prior Art:

There are known fried or roasted potato foods of various configurations such as flat slice potato chip shape, crinkle cut shape, V-cut shape, julienne cut shape and stick or shoestring shape, the last shape being obtained by cutting a potato of the flat slice potato chip shape with an appropriate width.

In most cases, food materials have been cut by the use of a cutting apparatus having a cylindrical housing formed with a plurality of slots extending parallel to the axis of the cylindrical housing, and a cutting element mounted in each of the slots and protruding slightly inwardly from the inner wall of the housing. When the housing is rotated while pressing a food material against the inner wall of the housing, the food material is cut into a given configuration with the cut material sections being discharged outside of the cylindrical housing through the slots formed therein.

Flat plate-shaped cutting elements are used to obtain flat slice potato chips. To cut the potato into the crinkle or V-shape, a cutter is used having cutting elements held respectively by holders and cramps, each of the cutting elements having a cutting edge of rounded or sharpened wave configuration. The distal ends of the holders and cramps adjacent to the cutting edges of the cutting elements are similarly shaped into a rounded or sharpened wave configuration. Each of the holders includes a stepped portion formed thereon intermediate between the opposite ends thereof and which is adapted to abut the proximal end of each cutting element. The intermediate section of the cutting element is held between the distal ends of the holder and cramp.

The known cutter for cutting food materials into the julienne or stick shape comprises flat plate-shaped cutting elements, a vertical cutting element placed on each of the flat plate-shaped cutting elements behind the cutting edge or the latter, the vertical cutting element having a plurality of vertically extending cutting edges, a lower holder having its distal end located between the cutting edges of the co-operating cutting elements, and an upper cramp having its distal end located substantially at the same position as the vertical cutting edges of the vertical cutting element and including longitudinally extending slots into each of which one of the vertically extending cutting edges is fitted, the flat plate-shaped and vertical cutting elements being held by co-operation of the holder with the cramp.

SUMMARY OF THE INVENTION

In view of the aforementioned prior art, it is an object of the present invention to provide a cutter which can cut food materials first into a rounded or sharpened wave shape and then into julienne shape to form chips of a unique configuration which is easy to be eaten, not easy to break in shipping and can efficiently be fried or roasted.

Another object of the present invention is to provide a cutter in which its cutting elements can be replaced by other and new cutting elements more easily than the prior art cutters. In the cutters of this type, normally, the cutting elements should be exchanged for new cutting elements after each service period of several tens of minutes to several hours.

Still another object of the present invention is to provide a cutter of more durable construction. The cutting elements having higher hardness are generally held integrally by holders having lower hardness. The durability of the cutter is important because an irregular cutting or broken parts may be created if the integrity of the cutter construction should be lost.

A further object of the present invention is to provide a cutter in which its portion contacting a food material to be cut has no projection which would otherwise provide chips of irregular cross-section and create clogging of the chips.

These objects are accomplished in accordance with the present invention by providing a cutter which has a holder including a corrugated distal end and an intermediate stepped portion forming a rearwardly extending groove, a corrugated cutting element disposed on the holder and including a corrugated cutting edge extending forwardly of the distal end of the holder and a rearward end engaged in the groove, a vertical cutting element located on the corrugated cutting element and including a plurality of vertically extending blades provided therein and spaced away from one another by a constant distance and a rearward end engaged in the groove, and a clamp fixedly attached to said holder and pressed into engagement with the corrugated and vertical cutting elements, the distal end edge of the clamp having a corrugation corresponding to that of the corrugated cutting element and having slots each of which receives one of the vertically extending blades of the vertical cutting element and has a length larger than the width of the blade.

DESCRIPTION OF PREFERRED EMBODIMENT

Figure 1:
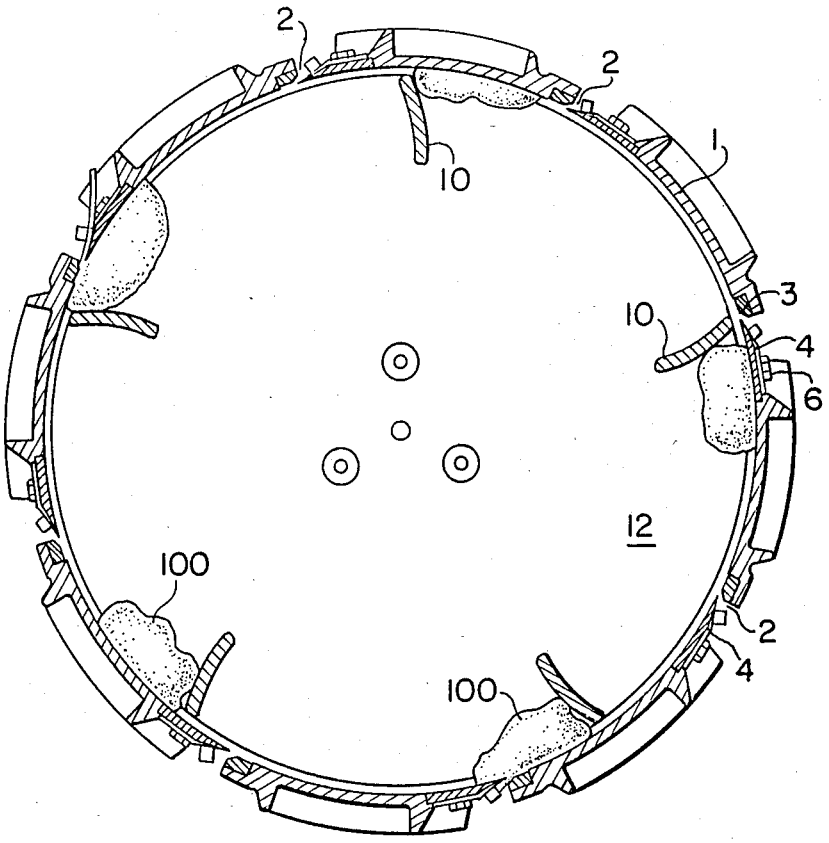
FIG. 1 is a horizontal cross-section of a cutting apparatus constructed in accordance with the present invention.

Referring to FIG. 1, there is shown a cutting apparatus which has a cylindrical housing 1 formed with slots 2 (eight in the illustrated embodiment) extending parallel to the axis of the cylindrical housing 1. A gate insert 3 is fixedly attached to one side of each of the slots 2 and serves to adjust the thickness of the cut material. The other side of the slot 2 receives a cutting assembly 4 fixedly attached thereto by means of machine screws 6. the cutting edge portion of the cutting assembly 4 is positioned to extend slightly inwardly from the internal surface of the gate insert 3 (that is, toward the axis of the cylindrical housing).

The cylindrical housing 1 rotatably receives an impeller 12 including a plurality of blades 10 (five in the illustrated embodiment) and adapted to rotate clockwise as viewed in FIG. 1.

Figure 2:
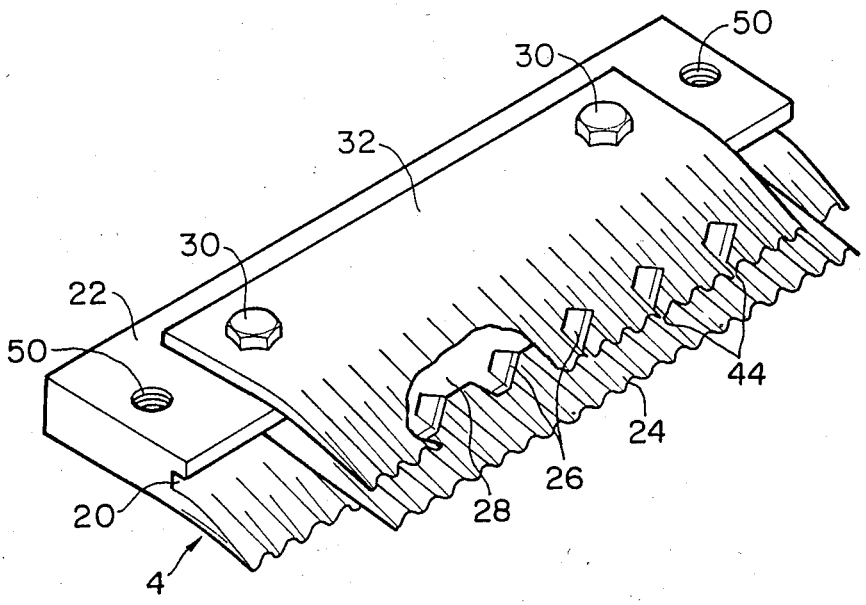
FIG. 2 is a perspective view of a cutting assembly according to the present invention.

As seen from FIG. 2, the cutter assembly 4 has a holder 22 having a downwardly tapered and corrugated distal edge and a central stepped portion forming a horizontal groove 20, a cutting element 24 having a cutting edge with a corrugation substantially coinciding with that of the distal edge of the holder 22, a vertial cutting element 28 including a plurality of vertically extending cutter blades 26 spaced away from one another along the length of the vertical cutting element 28, and a clamp 32 mounted on the holder 22 by means of screws 30 and having a downwardly tapered distal edge with a corrugation coinciding with that of the distal edge of the holder 22.

Figure 3:
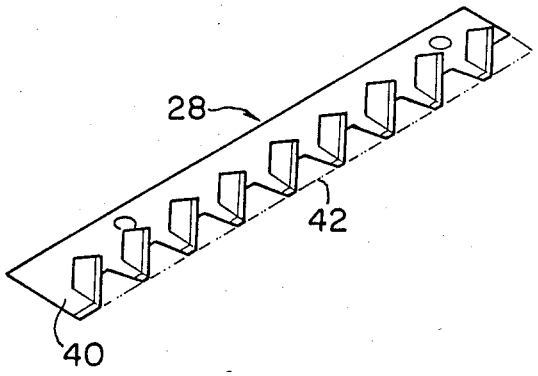
FIG. 3 is a perspective view of a vertical cutting element used in the present invention.

The rearward ends of the cutting elements 24 and 28 are received in the horizontal groove 20 in the holder 22. As seen from FIG. 3, the vertical cutting element 28 may be formed by sharpening an elongated strip of blade material 40 at one side edge 42 shown by a phantom line in FIG. 3, notching it into L-shape from the sharpened side edge 42 and vertically folding the notched material portions to form the vertically extending cutter blades 26. The distal end edge of the clamp 32 includes a plurality of longitudinally extending slots 44 formed therein for receiving the respective one of the vertically extending cutter blades 26 on the vertical cutting element 28. The length of each of the longitudinal slots 44 is slightly larger than the width of the corresponding blade 26. Thus, the cutting element 24 is held by the horizontal groove 20 of the holder 22 as well as the distal end edges of the holder 22 and clamp 22, 32 which are substantially in the same position. The vertical cutting element 28 is held by the top corrugated face of the cutting element 24, the clamp 32 and the horizontal groove 20 of the holder 22. The holder 22 is provided with apertures 50 for fixedly attaching it to the cylindrical housing 1.

In such an arrangement, for example, when potatoes 100 are placed within the impeller 12 and then the latter is rotated clockwise, the potatoes 100 are pressed against the internal circumference of the impeller 12 under the centrifugal force and then moved by the blades 10 along the inner wall of the cylidrical housing 1. As a result, the potatoes 100 can be cut by the cutter assemblies 4 into the unique configuration and then discharged outwardly through the slots 2.

It is to be understood from the foregoing that the present invention provides a cutter which can efficiently and regularly cut food materials into the unique configuration since the cutting elements are rigidly held by the holders and clamps while at the same time the distal end edges of the holders and clamps have no projections leading to any clogging of the cut food materials.

I claim:

1. A cutter for food materials, comprising holder means including a corrugated distal end and an intermediate stepped portion forming a rearwardly extending groove, corrugated cutting means disposed on said holder means and including a corrugated cutting edge extending forwardly of the distal end of said holder means and a rearward end engaged in said groove, vertical cutting means located on said corrugated cutting means and including a plurality of vertically extending blades provided therein and spaced away from one another by a constant distance and a rearward end engaged in said groove, and clamp means and pressure fixedly attached to said holder means into engagement with said corrugated and vertical cutting means, the distal end edge of said clamp means having a corrugation corresponding to that of said corrugated cutting means and having slots each of which receives one of said vertically extending blades of said vertical cutting means and has a length larger than the width of the blade.

2. A cutter as defined in claim 1, wherein said vertical cutting means is formed by sharpening a strip of blade member at one end edge and then vertically folding a plurality of notched material portions to form the vertically extending blades.

* * * * *